United States Patent [19]

Wilhlem

[11] Patent Number: 4,991,850

[45] Date of Patent: Feb. 12, 1991

[54] GOLF SWING EVALUATION SYSTEM

[75] Inventor: Donald F. Wilhlem, Maumee, Ohio

[73] Assignee: Helm Instrument Co., Inc., Maumee, Ohio

[21] Appl. No.: 289,231

[22] Filed: Dec. 22, 1988

Related U.S. Application Data

[63] Continuation-in-part of Ser. No. 151,068, Feb. 1, 1988, abandoned.

[51] Int. Cl.[5] ..... A63B 69/36

[52] U.S. Cl. ..... 273/186 A; 273/186 R; 273/183 D; 273/183 R; 273/186 C

[58] Field of Search ..... 273/35 R, 183 R, 183 B, 273/183 D, 184 R, 186 R, 186 A, 186 C, 193 R; 340/323 R; 73/379, 488, 489, 490, DIG. 4

[56] References Cited

U.S. PATENT DOCUMENTS

| | | | |
|---|---|---|---|
| 3,270,564 | 9/1966 | Evans | 73/432 |
| 3,717,857 | 2/1973 | Evans | 340/177 R |
| 3,788,647 | 1/1974 | Evans | 273/186 A |
| 3,792,863 | 2/1974 | Evans | 273/186 A |
| 3,806,131 | 4/1974 | Evans | 273/186 A |
| 3,897,058 | 7/1975 | Koch | 273/26 B |
| 3,945,646 | 3/1976 | Hammond | 273/186 A |
| 4,088,324 | 5/1978 | Farmer | 273/186 A |
| 4,103,896 | 8/1978 | Lorang | 273/183 D |
| 4,138,118 | 2/1979 | Budney | 273/183 D |
| 4,270,753 | 6/1981 | Maroth et al. | 273/186 A |
| 4,363,488 | 12/1982 | Maroth et al. | 273/186 A |
| 4,453,716 | 6/1984 | Oppenheimer | 273/186 A |
| 4,523,759 | 6/1985 | Igarashi | 273/169 |
| 4,527,156 | 7/1985 | Nawrocki et al. | 340/753 |
| 4,554,534 | 11/1985 | Jones | 340/665 |
| 4,615,526 | 10/1986 | Yasuda et al. | 273/186 C |

FOREIGN PATENT DOCUMENTS 2066676 7/1981 United Kingdom .

OTHER PUBLICATIONS

"Analyst" advertisement, *Golf Digest* p. 7, Nov. 1982.

*Primary Examiner*—Edward M. Coven
*Assistant Examiner*—Jessica J. Harrison
*Attorney, Agent, or Firm*—Marshall & Melhorn

[57] ABSTRACT

A golf swing evaluation system includes a golf club containing a sensor and an associated display for indicating the force and location of the impact of the club head against a golf ball. The sensor generates a sensor signal to a force circuit which generates an indication signal having characteristics of the impact. The indication signal is sent to a graphic display and/or a computer for evaluation. The sensor can also be an accelerometer for generating the acceleration characteristics of the club head throughout the swing. Several sensors can be utilized to provide information as to the location of the impact. The display can be located in the club grip or worn by the golfer.

16 Claims, 3 Drawing Sheets

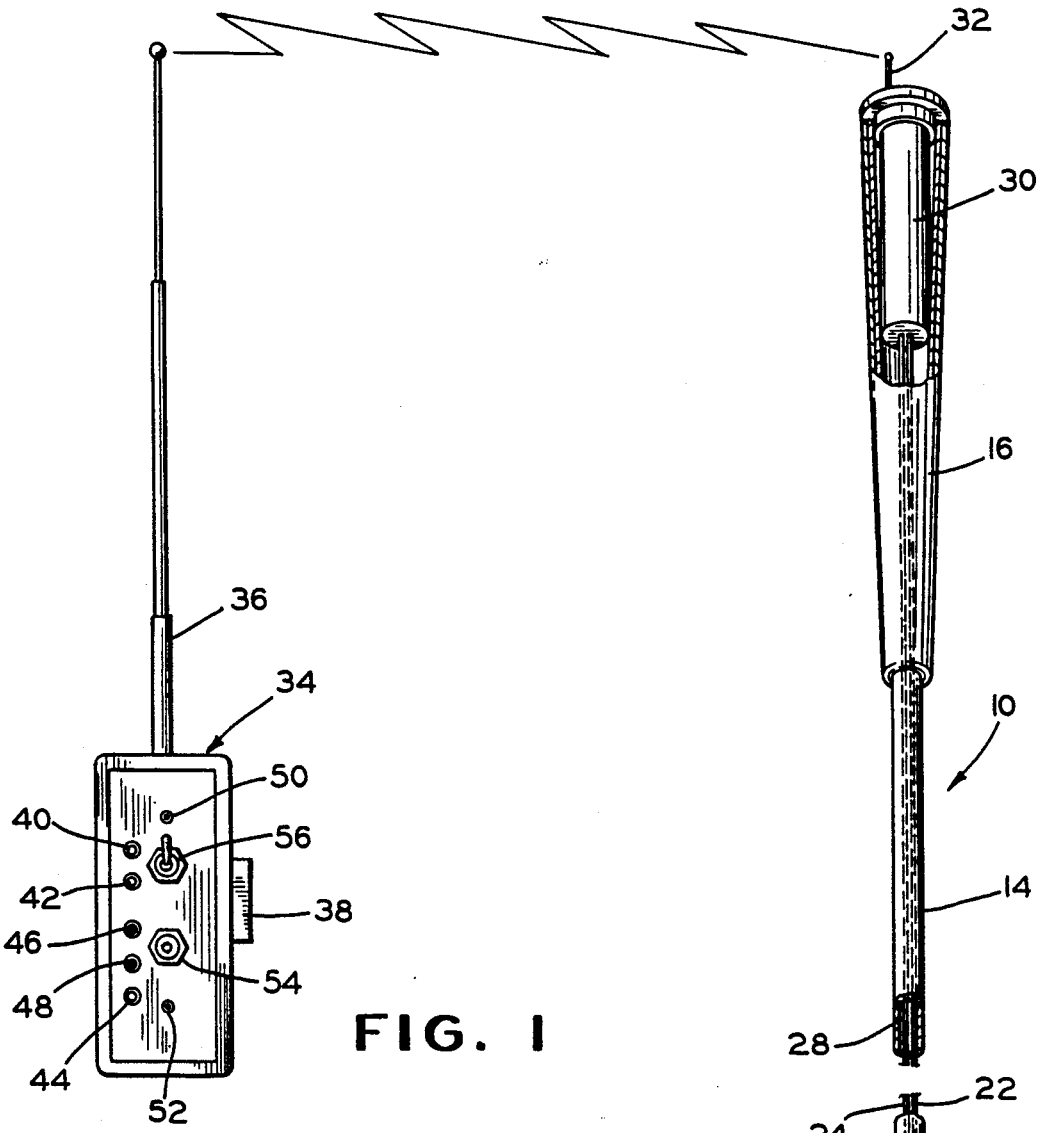
FIG. 1
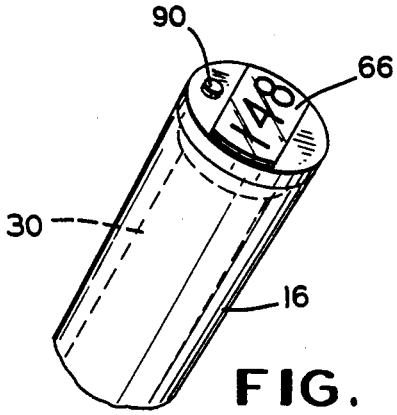
FIG. 2
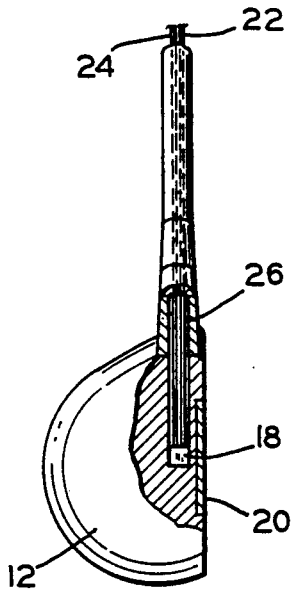

GOLF SWING EVALUATION SYSTEM

BACKGROUND OF THE INVENTION

This application is a continuation-in-part of U.S. Pat. Application Ser. No. 07/151,068, filed Feb. 1, 1988, now abandoned.

The present invention relates to a golf swing evaluation system, and more particularly to a golf club having a sensor in the club head and associated display for indicating the forces applied to a golf ball.

There are various sports which require an athlete to utilize a club or some similar implement for swinging at a ball. One example is the sport of golf wherein the golfer athlete utilizes a golf club to drive a stationary golf ball positioned on either a golf tee or on the ground in front of him. In the past, various types of equipment have been proposed and produced to enable a golfer to improve his power and swing. Complicated guide rails of various kinds were used, especially with beginners or newcomers to the game. Motion pictures of the swing were analyzed, to reveal faulty stances and accurate travels of the club. Instructors would study a golfer's swing to ascertain faults or opportunities for possible improvement and speed checks were made, to show club speed at various points in the path of movement. These practices were all employed to recognize certain faults in the way a golfer swings his club.

U.S. Pat. No. 4,138,118 discloses a handle for a golf club which is provided with pressure sensitive transducers at locations corresponding to the positions at which a player exerts pressure with the thumb of one hand and with the last three fingers of the other hand. The electrical outputs of the transducers are transmitted to a pen recorder which provides traces from which faults in the player's technique can be determined. The traces of the player with the faulty technique are then compared with corresponding traces produced by an expert golfer in order to determine the area of fault.

U.S. Pat. No. 4,453,716 discloses a transverse force indicating device for assisting in the teaching of a smooth swing for a golf club or other rod-like object. The device includes a joint apparatus interconnecting bifurcated guide rods on a swing teaching apparatus or a bifurcated club, club extension, or attachment member. The joint apparatus may be a balsa wood dowel interconnecting the bifurcated first and second rod members or may be a ball and socket arrangement which has a spring or other suitable locking device to maintain a coaxial orientation of the first and second rod members unless the transverse shear force exerted by or against the first rod member during a swing of the club by a user is greater than a predefined amount.

U.S. Pat. No. 3,270,564, U.S. Pat. No. 3,945,646 and U.K. Pat. No. 2,066,676 each show a golf club with an accelerometer embedded in the club head. In each case, the accelerometer generates a signal proportional to the club head acceleration/deceleration and velocity.

It is an object of the present invention to provide a means of measuring the impact force on a golf ball when struck with a golf club.

It is a further object of the present invention to provide a golfer with a method to select a golf club with the proper combination of swing weight and shaft stiffness to suit his strength and stature.

SUMMARY OF THE INVENTION

In accordance with the present invention, a piezoelectric sensor is embedded behind the face plate of the head of a golf club on the center of balance or "sweet spot" of the head face. The sensor is light in weight and does not affect the normal performance of the golf club when in use. The sensor is electrically connected to an electronic circuit mounted in the shaft at the grip portion of the club. The electronic circuit is powered by long life batteries encased with the circuit.

The electronic circuit includes signal conditioning and scaling circuits, a peak capture circuit to hold the information to display, as well as an FM transmitter to send the information to a nearby receiver. The information sent to the receiver is stored in a digital circuit, such as a random access memory chip, for example, and can be transferred to a computer and eventually plotted on an appropriate graphic recorder.

The piezoelectric sensor can be a force sensor or an acceleration sensor. If a force sensor is utilized, the stored information includes the impact force applied to the ball and the time in microseconds that the club face was in contact with the ball. The information stored also allows the study of the elastic properties of both the club face material and the ball.

If an accelerometer is utilized as the sensor, information on the acceleration and deceleration of the club head throughout the entire swing is generated. Thus, it can be determined when the golfer breaks his wrists to enable the golfer to correct his timing.

In a first alternate embodiment, the display can be mounted in the end of the grip portion of the club. In a second alternate embodiment, two or more sensors can be utilized to provide an indication of the location of the impact on the face of the club. The electronic circuit can be carried by the golfer, such as on his/her wrist, and connected by a cable to the sensors in the club head.

BRIEF DESCRIPTION OF THE DRAWINGS

The above objects and advantages of the invention will become manifest to one skilled in the art from considering the following detailed description of an embodiment of the invention in light of the accompanying drawings in which:

FIG. 1 is a fragmentary perspective view of a golf club incorporating the present invention;

FIG. 2 is a fragmentary enlarged perspective view of an alternative embodiment of the present invention mounted in the end of a golf club.

DESCRIPTION OF THE PREFERRED EMBODIMENTS

Figure 3:
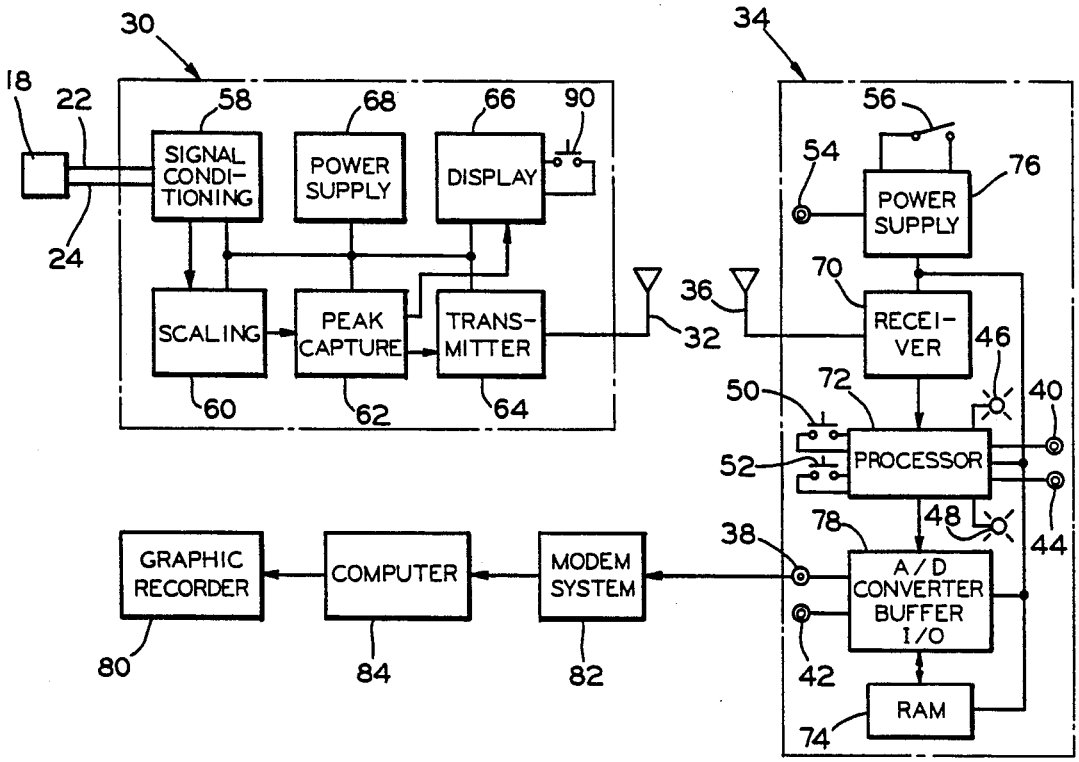
FIG. 3 is a block diagram of the invention shown in FIGS. 1 and 2.

Turning now to FIG. 1, there is illustrated a golf club 10 comprised of a club head 12 attached at one end of a shaft 14 and a grip portion 16 attached at the other end of the shaft 14. The grip portion 16, fashioned of leather, for example, is used for grasping by a human hand.

In accordance with the present invention, the club head 12, constructed of wood, for example, is provided with a piezoelectric sensor 18 which generates a sensor signal representing characteristics of the impact of the club head 12 on a golf ball. The sensor 18 is positioned within the club head 12 and embedded behind a face plate 20 attached to the head. The sensor 18 is located at the "impact zone" of the club head. The impact zone is located on the center of balance of the club head and is usually referred to as the "sweet spot". The performance of the club user's swing is not affected by the weight of the sensor 18, since the sensor 18 typically weighs less than a gram.

The sensor 18 is connected to two wires 22 and 24 which extend through a hole or cavity 26 formed in the head 12 of the club 10. The wires 22 and 24 continue through the hole or cavity 26 and into a longitudinally extending cavity 28 formed in the shaft 14. The wires 22 and 24 extend the entire length of the cavity 28 in the shaft 14 where they electrically connect the sensor 18 to a force circuit 30 located in the grip portion 16 of the golf club 10.

The force circuit 30 includes signal conditioning and scaling circuits, as well as a peak capture circuit to hold the sensor signal received from the sensor 18. The force circuit 30 is responsive to the sensor signal received from the sensor 18 and thereby generates an indication signal which is representative of the characteristics of the impact of the club head 12 against a golf ball. The force circuit 30 further contains a small, low power FM (frequency modulated) transmitter with an output antenna 32 which sends the indication signal to a nearby FM (frequency modulated) receiver in a data storage module 34. The energy necessary to power the circuits and the FM transmitter is provided by long life batteries encased with the previously mentioned force circuit 30.

The information obtained from the sensor 18 is sent to the nearby FM receiver by the FM transmitter. The information is stored by the module 34 in a digital circuit, such as a random access memory chip, for example. The module 34 includes an input antenna 36, a pin connector 38, plug in jacks 40, 42 and 44, indicator lights 46 and 48, push buttons 50 and 52, an adapter plug 54 and a switch 56. The module 34 is a commercially available unit which can be obtained under the trade designation "Ramcorder" from the Helm Instrument Co of Maumee, Ohio. The module 34 obtains power from a nine volt battery encased therein by placing the switch 56 in the on position, which prepares the receiver for data acquisition from the force circuit 30. As the user of the golf club swings a sensor signal generated by the sensor 18 is sent to the force circuit 30 where it is generated as an indication signal which is sent by the FM transmitter to the FM receiver. The indication signal is received by the antenna 36 and is stored within the module 34 in the digital circuit.

The output circuit module 34 is connected through the pin connector 38 to an appropriate computer which can interpret the indication signal received by the FM receiver 34 from the force circuit 30. The interpreted information can be plotted by a suitable graphic recorder. Some of the information plotted would, for example, indicate the time in microseconds that the club face was in contact with a golf ball, the entire force curve and the maximum force of the impact.

The force circuit 30 and the receiver 34 are shown in block diagram form in FIG. 3. The sensor signal is generated by the sensor 18 on the pair of lines 22 and 24 which lines are connected at an input of a signal conditioning circuit 58 in the circuit 30. The signal conditioning circuit 58 generates an output signal to a scaling circuit 60 which in turn generates an output signal to a peak capture circuit 62. Typical signal conditioning, scaling and peak capture circuits are disclosed in U.S. Pat. No. 4,527,156 and U.S. Pat. No. 4,554,534, both patents assigned to the assignee of the present invention. Outputs from the peak capture circuit 62 are connected to an FM transmitter 64 and to a means for generating a visual indication such as a display 66. An output from the transmitter 64 is connected to the antenna 32. All of the circuits in the force circuit 30 obtain power from a power supply 68 which can be a long-life battery, for example.

The indication signal transmitted through the antenna 32 is received on the antenna 36 which is connected to an FM receiver 70 which demodulates the information and sends it to a signal processor 72. The signal processor 72 stores the information in a random access memory chip (RAM) 74 for later use. All of the circuits in the module 34 are connected to a power supply 76 which can be a long-life battery, for example. The on/-off switch 56 is connected to the power supply 76 for turning on and turning off the module 34. The plug 54 is connected to the power supply 76 for receiving charging current from an external source (not shown).

The jack 40 is connected to the processor 72 to provide an input for serial digital data. The push button switch 50 is connected to the processor 72 for controlling the input of the data through the jack 40. The jack 40 is convenient, for example, if the user of the present invention desires to acquire data from remote sensors. Typical remote sensors could include a device for sensing the impact of the golf ball on a target in order to determine distance and accuracy. Such remote sensors would be connected to the jack 40 and would continuously generate the sensed information to make it available for storage when the push button switch 52 is actuated.

The jack 44 is connected to the processor 72 to provide an input for analog signals which also could be generated by the sensors described above. The push button switch 52 is connected to the processor 72 for controlling the storage of analog signals at the jack 44 in the RAM 74. The processor 72 has the capability of changing analog signals into digital information for storage in the RAM 74, such analog signals including the information received on the antenna 36 and the signals at the jack 44.

The pin connector 38 is connected to an output of an A/D convertor, buffer, and input/output (I/O) circuit 78. Analog data from the information signal at the antenna 36 or at the input jack 44 is converted to digital form by the circuit 78 before being stored in the RAM 74. The circuit 78 also serves as a buffer to hold data from the RAM 74 before the data is sent to an output device. Finally, the circuit 78 serves as an input/output device for the data being transferred from the processor 72 to the RAM 74 and from the RAM 74 to the pin connector 38 and the jack 42. The pin connector 38 is connected to an output of the circuit 78 to provide parallel data transmission capability to a device such as a graphic recorder 80. The pin connector 38 can be connected to a modem system 82 which typically consists of a pair of modems connected to a telephone line for remote data transfer. The modem system 82 can be connected to a computer 84 or connected directly to the graphic recorder 80. The computer 84 can be utilized to store large amounts of data and process the data for generating desired presentations on the graphic recorder 80 or an associated display device. The pin connector 38 can also be connected directly to the graphic recorder 80. The jack 42 is connected to the circuit 78 for providing an alternate output for information to the graphic recorder 80.

The indicator lights 46 and 48 are also connected to the processor 72. The indicator light 46 serves to present a visual indication that data is either being received or transmitted. The light 48 serves to provide a visual indication when the output voltage of the power supply 76 falls below a predetermined value.

Figure 4:
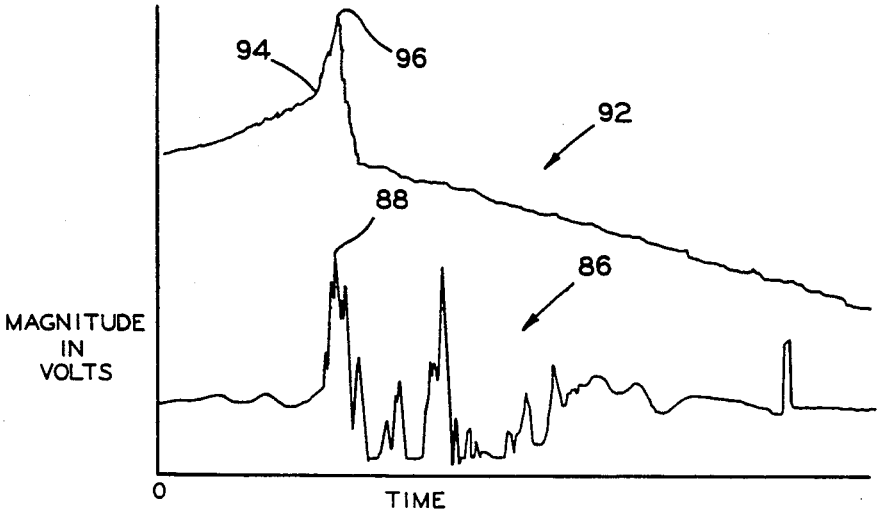
FIG. 4 is a wave form diagram of the information generated, stored and displayed by the present invention.

In operation, the golfer strikes the ball generating a sensor signal at the sensor 18. The sensor signal is received by the force circuit 30 through the wires 22 and 24. An indication signal is generated by the force circuit 30, the indication signal corresponding to the magnitude of the impact versus time as shown in FIG. 4 as a wave form 86. The indication signal is sent from the force circuit 30 by means of an electromagnetic wave from the FM transmitter 64 through the antenna 32 located in the end of the golf club 10. The electromagnetic FM wave is received by the antenna 36 of the FM receiver 70. The indication signal information is then stored in the RAM 74 located within the module 34. Each time the golfer strikes a golf ball, the information concerning the signal is sent to the module 34 for storage. After the golfer finishes with the club, the module 34 is taken to an appropriate computer 84 where it is attached to the computer means of the pin connector 38. The information stored in the RAM 74 of the module 34 is transferred to the computer 84 where it is recorded on the graphic plotter 80, for example. The computer generated plots can then be analyzed to improve the golfer's golfing performance.

In an alternative embodiment, as illustrated in FIG. 2, the grip portion end 16 of the shaft is provided with the display 66 which is responsive to the indication signal generated by the peak capture circuit 62. The peak capture circuit 62 passes the analog wave form 86 of FIG. 4 to the FM transmitter 64. The peak capture circuit 62 also recognizes the highest magnitude 88 achieved by the wave form 86 and stores the highest value as a peak magnitude signal which is generated to the display 66. The display 66 converts the analog value to a digital number for a visual indication of the peak magnitude of the impact to the golfer. The display 66 is also provided with a push button switch 90 which is used to reset the digital display to zero before the golfer strikes a ball on the next swing.

In operation, the golfer would strike the ball and then read the force on the display 66. Before the next swing, the golfer would push the button 90 on the end of the shaft to reset or zero the display 66. The golfer would then again strike the ball, read the display 66 and compare the force values. The force values are a function of the mass times the acceleration of the club and therefore directly relate to the distance that the golf ball will travel after impact. Since the present invention provides the force value of each swing, it allows the golfer the ability to apply principles to his swing which will result in a higher force value, which in turn equates to longer distances traveled by the golf ball and concurrently better golfing performance.

If the piezoelectric sensor 18 is an accelerometer, the signal generated on the lines 22 and 24 will represent the acceleration of the club head during the swing As shown in FIG. 4, a club head acceleration curve 92 increases in acceleration value toward a point 94 at which the golfer's wrists break. At the point 94, the curve turns sharply upward to a maximum at an impact between the club head and a golf ball at 96. The club head then decelerates on the follow through. The abrupt change in the value of the acceleration at 96 can be utilized to generate an impact force value since force equals mass times acceleration.

Figure 5:
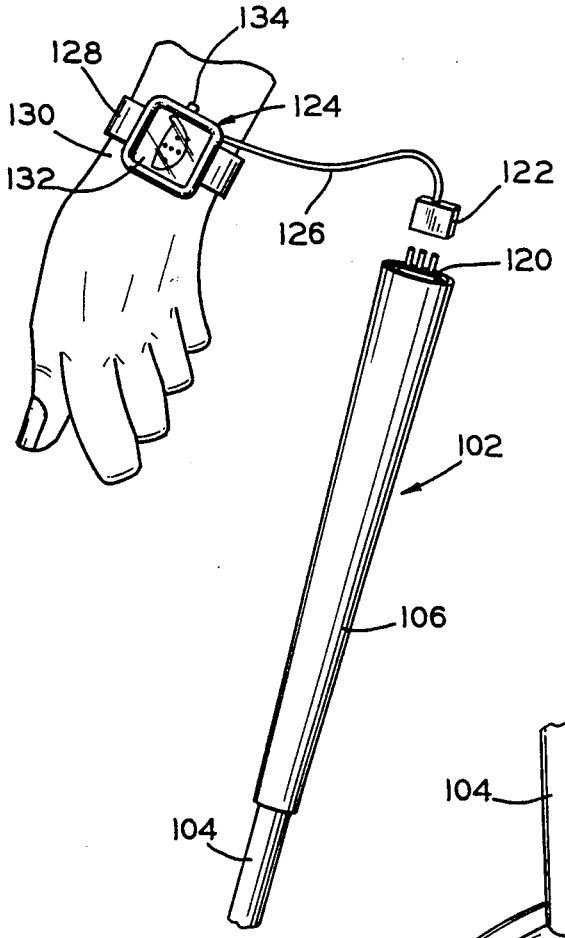
FIG. 5 is a fragmentary perspective view of a golf club incorporating a second alternative embodiment of the present invention.
Figure 6:
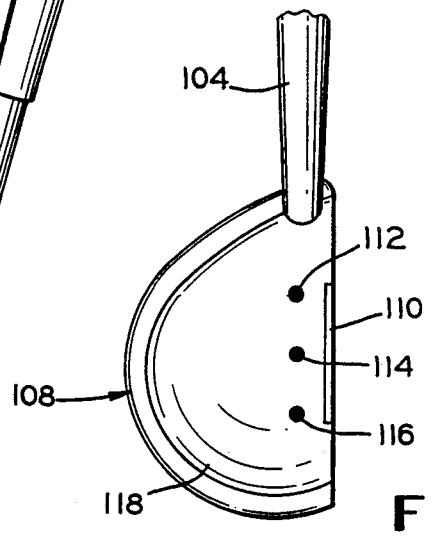
FIG. 6 is an enlarged fragmentary top plan view of the club head of the golf club shown in FIG. 5.

There is shown in FIG. 5 a second alternative embodiment of the present invention incorporated in a golf club 102 having a shaft 104 attached to a grip portion 106. A club head 108 is shown in FIG. 6 and can be attached to the shaft 104 opposite the grip portion 106. The club head 108 includes a face plate 110 behind which are positioned a plurality of sensors similar to the sensor 18 of FIG. 1. For example, three such sensors can be embedded in the club head 108 at positions behind the face plate 110 which positions can be indicated by corresponding dots 112, 114 and 116 located on an upper surface 118 of the club head 108. For example, the dot 114 can indicate a sensor located in the "impact zone" of the club head The dot 112 can indicate a sensor located at a position between the "impact zone" and an edge of the face plate 110 adjacent the shaft 104, while the dot 116 can indicate a sensor located between the "impact zone" and an opposite edge of the face plate 110. As will be discussed below, the dots 112, 114 and 116 are representative of a plurality of sensors which can be located at various desired positions in the club head 108.

The sensors (not shown) embedded in the club head 108 are connected by wires (not shown) which extend through the club head 108 and through the shaft 104 to the upper end of the grip portion 106 where they are connected to a male portion 120 of an electrical connector. The male portion 120 cooperates with a female portion 122 of the connector to provide the sensor signals to a display device 124 over a cable 126. The display 124 can be mounted on a strap 128 to be worn about the wrist 130 of a golfer.

Figure 7:
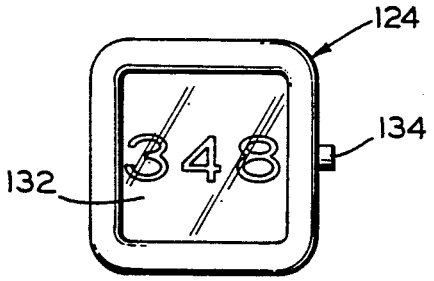
FIG. 7 is an enlarged front elevation view of the display shown in FIG. 5 in the force indicating mode.
Figure 8:
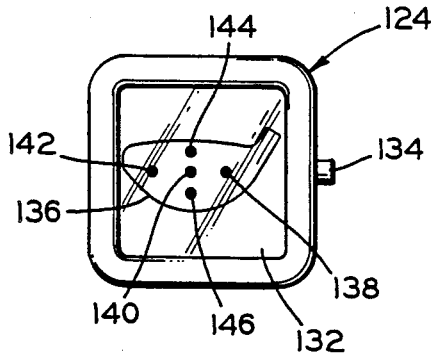
FIG. 8 is an enlarged front elevation view of the display shown in FIG. 5 in the impact location mode.

As best shown in FIGS. 7 and 8, the display 124 includes a display screen 132 which can be formed of any suitable display elements, for example, a LCD (liquid crystal display) screen. The display 124 can be provided with a mode switch 134 for selecting the information to be displayed. In FIG. 7, the display is in the force indicating mode. A three digit number can be displayed on the screen 132 to provide a digital indication of the peak impact force when the golf ball is struck by the club head 108. In the impact location indicating mode shown in FIG. 8, a plurality of dots can be utilized to indicate the location of the impact of the club head on the ball. The screen 132 displays an outline 136 of the club head 108. Dots 138, 140 and 142 indicate the location of sensors imbedded in the club head and generally correspond to the dots 112, 114 and 116 respectively. The sensor generating the highest peak magnitude signal will cause the corresponding one of the dots 138, 140 and 142 to be activated. However, these dots only give an indication of the location of the impact along a horizontal line. A pair of dots 144 and 146 can be located respectively above and below the dot 140 to provide an indication of the impact area in a vertical plane. Assuming that the golf ball is struck in a manner such that the sensor associated with the dot 138 generates the largest peak magnitude, and that the impact is also above the horizontal center line of the club face, both the dot 138 and the dot 144 can be activated to convey this information. In the alternative, additional dots can be added to the display with each dot corresponding to a separate sensor embedded in the club head.

Figure 9:
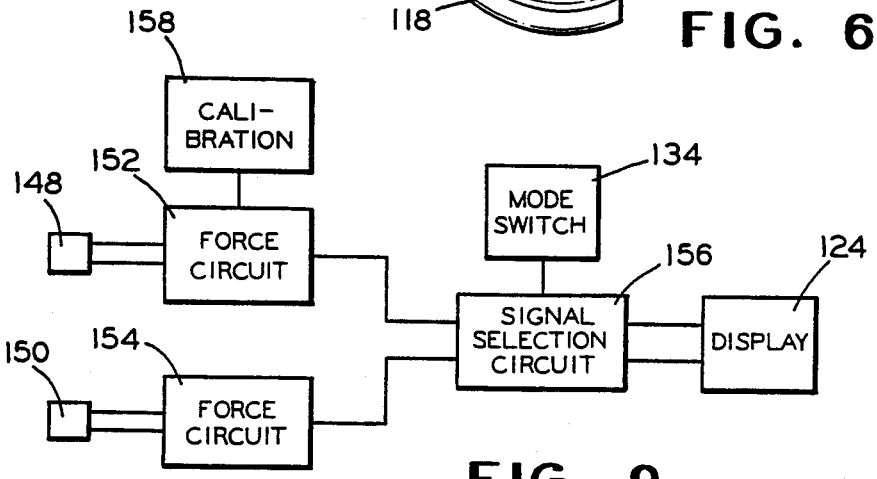
FIG. 9 is a block diagram of the circuitry according to the invention shown in FIGS. 5–8.

There is shown in FIG. 9 a block diagram of the circuitry for the second alternative embodiment of the present invention. A pair of sensors 148 and 150 are similar to the sensor 18 of FIG. 1 and are representative of a plurality of such sensors embedded in the club head 108. The sensors 148 and 150 are each connected to an associated one of a pair of force circuits 152 and 154 respectively. Each of the force circuits 152 and 154 can for example, include the signal conditioning circuit 58, the scaling circuit 60 and the peak capture circuit 62 of FIG. 3. The output signals from the force circuits 152 and 154 are connected to a signal selection circuit 156. The signal selection circuit 156 can be mounted in the grip portion 106 in the display 124, or split between those two locations.

The mode switch 134 is connected to the signal selection circuit 156 and the output from the signal selection circuit 156 is connected to the display device 124. The signal selection circuit 156 operates in a conventional manner to select the highest one of the peak magnitudes generated by each of the sensors. When the mode switch 134 is in the force indicating mode the highest peak magnitude is converted to a digital signal and displayed on the screen 132 as shown in FIG. 7. In order to determine where the ball was struck, the mode switch is activated and the impact location mode display shown in FIG. 8 indicates the location of the impact with the golf ball with respect to the striking face of the club head. The mode switch 134 can also function as a reset button to clear the displays.

The display device 124 can be utilized with more than one golf club. A means for calibrating the sensor signals, such as a calibration circuit 158, can be included in a portion of the force circuit 152 located in the golf club to generate the sensor signal with a range of predetermined magnitudes corresponding to associated impact forces. Thus the sensors in each club can be calibrated to generate the same sensor signal for a particular impact force and the display will read the same number for all such calibrated clubs. A portion of the force circuit for generating the indication signal can be located in the display device 124.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A golf swing evaluation system comprising:

a golf club including a shaft having a club head with a golf ball striking face attached at one end and a grip portion attached to an opposite end;

a plurality of sensing means embedded within said club head and oriented for sensing an impact of said striking face on a golf ball and for generating associated sensor signals representing characteristics of said impact including at least a force of said impact and a location of said impact on said striking face;

a force circuit electrically connected to said sensing means and being responsive to said sensor signals for generating an indication signal representing said characteristics of said impact; and means responsive to said indication signal for generating a visual indication of said characteristics of said impact, said visual indication including a peak magnitude force indication and a graphic indication of the location of said impact on said striking face.

2. The system according to claim 1 wherein at least one of said sensing means is a piezoelectric force sensor.

3. The system according to claim 1 wherein said sensing means are positioned behind a face plate attached to said club head.

4. The system according to claim 1 wherein said force circuit includes a signal conditioning circuit having a input connected to said sensing means, a scaling circuit having an input connected to an output of said signal conditioning circuit, and a peak capture circuit having a input connected to an output of said scaling circuit for generating said indication signal at an output.

5. The system according to claim 4 wherein said force circuit includes a radio transmitter connected to said peak capture circuit for transmitting said indication signal and said means for generating a visual indication includes a receiver circuit responsive to said transmitted indication signal for generating said visual indication of said characteristics of said impact.

6. The system according to claim 5 wherein said force circuit includes a random access memory connected to said receiver circuit for storing said indication signal.

7. The system according to claim 5 wherein said force circuit includes means for calibrating connected to said sensing means for generating said sensor signal with a range of predetermined magnitudes corresponding to associated ones of said impact forces.

8. The system according to claim 7 including a display device remote from said golf club and having said means for generating a visual indication located therein, and a cable connecting said display device to said grip portion.

9. The golf swing evaluation system according to claim 1 including means for calibrating the magnitude of said sensor signals located in said golf club, a display device remote from said golf club, and means for transmitting said sensor signals to said display device.

10. The golf swing evaluation system according to claim 9 wherein said means for transmitting is one of a detachable cable and a radio transmitter and receiver.

11. The golf swing evaluation system according to claim 1 wherein said means for generating a visual indication includes a mode switch for selecting one of said impact characteristics to be indicated as a visual display.

12. The golf swing evaluation system according to claim 1 wherein said means for generating a visual indication includes a reset button for resetting a visual indication of said characteristics of said impact.

13. A golf swing evaluation system for use with a golf club having a shaft with a club head attached at one end and a grip attached at an opposite end comprising:

a piezoelectric force sensor for sensing the impact of a club head on a golf ball and generating a sensor signal representing characteristics of said impact;

a force circuit having a signal conditioning circuit with an input connected to said force sensor, a scaling circuit with an input connected to an output of said signal conditioning circuit, a peak capture circuit with an input connected to an output of said scaling circuit, a radio transmitter with an input connected to an output of said peak capture circuit, and an output antenna connected to an output of said radio transmitter, said output circuit module being responsive to said sensor signal for generating an indication signal representing characteristics of said impact including a force of said impact and a location of said impact; and a data storage module having an input antenna, a radio receiver with an input connected to said input antenna, a random access memory having an input connected to an output of said radio receiver for storing said indication signal, and a connector means connected to an output of said random access memory and adapted to be connected to a display device for generating a visual-indication of said indication signal.

14. The system according to claim 13 wherein said data storage module includes a processor circuit connected between said radio receiver output and said random access memory input for converting said indication signal from analog form to digital form.

15. The system according to claim 13 wherein said indication signal includes force magnitude versus time characteristics of the impact.

16. A golf swings evaluation system comprising:

a golf club including a shaft having a club head with a golf ball striking face attached at one end and a grip portion attached to an opposite end;

a force sensing means including a plurality of sensors embedded within said club head each for sensing an impact of said striking face on a golf ball and generating a sensor signal representing characteristics of said impact;

a force circuit electrically connected to said force sensing means and being responsive to said sensor signals for generating an indication signal representing said characteristics of said impact; and means responsive to said indication signal for indicating said characteristics of said impact including a force characteristic as a digital value and a graphic location characteristic impact location dots on an outline of said club head.

* * * * *